US005324205A

United States Patent [19]

Ahmad et al.

[11] Patent Number: 5,324,205

[45] Date of Patent: Jun. 28, 1994

[54] ARRAY OF PINLESS CONNECTORS AND A CARRIER THEREFOR

[75] Inventors: Umar M. U. Ahmad, Hopewell Junction; Arthur Bross, Poughkeepsie; George Czornyj, Poughkeepsie; Harry K. Harrison, Poughkeepsie; Richard R. Jones, Kerhonkson, all of N.Y.

[73] Assignee: International Business Machines Corporation, Armonk, N.Y.

[21] Appl. No.: 34,326

[22] Filed: Mar. 22, 1993

[51] Int. Cl.[5] ..... H01R 9/09

[52] U.S. Cl. ..... 439/66; 439/91

[58] Field of Search ..... 439/66, 91, 76, 591, 439/592, 844, 884

[56] References Cited

U.S. PATENT DOCUMENTS 3,934,959 1/1976 Gilissen ..... 439/66

4,295,700 10/1981 Sado ..... 439/91

4,793,814 12/1988 Zifcak et al. ..... 439/91

5,061,192 10/1991 Chapin et al. ..... 439/66

OTHER PUBLICATIONS

IBM Technical Disclosure (H. C. Schick), Plated Through-Hole Contact, vol. 6, No. 10, Mar. 1964, pp. 5 & 6.

*Primary Examiner*—Larry I. Schwartz

*Assistant Examiner*—Hien D. Vu

*Attorney, Agent, or Firm*—Whitham & Marhoefer

[57] ABSTRACT

A high density array of pinless electrical, spring connectors are supported in an electrically insulative carrier. The carrier has an array of cavity nests for receiving the spring connectors, locking them into a stable position and functioning as an electrical coupler between corresponding electrical contact pads in stacked modules.

7 Claims, 3 Drawing Sheets

ARRAY OF PINLESS CONNECTORS AND A CARRIER THEREFOR

BACKGROUND OF THE INVENTION

1. Field of the Invention

The present invention generally relates to means for electrically interconnecting multilayer substrates and, more particularly, to a carrier board for pinless connectors interposed between multilayer substrates and a circuit board for making electrical connections therebetween.

2. Description of the Prior Art

Electrical interconnections for stacked circuit boards have been extensively used in the prior art, but in each instance they seem to fall short of providing the reliability required in the computer industry. For instance, U.S. Pat. No. 4,793,814 to Zifeak et al. describes an electrically nonconductive support member for holding a plurality of electrically conductive interconnect elements for electrically interconnecting stacked circuit boards. This technique is quite effective in theory, but it has several inherent problems, the first being that during the fabrication of the interconnector board, the electrically conductive connectors are inserted through the elastomeric foam carrier and then the elastomeric material is allowed to set. Upon assembling and compressing the circuit boards and interconnector stack, the contacts make intimate contact with the electrical pads on the circuit boards, ceramic boards/cards and other products, and during the compression and contact wipe action, the respective ends of the interconnectors are essentially buried in the foam carrier, which makes for less pressure between the pads and the respective ends of the connectors, thereby effecting an insecure connection between the interconnector and circuit board pads. Another glaring problem occurs when a poor contact is formed between an interconnector and the circuit, requiring a replacement of the interconnector. In structure described in the Zifeak et al. patent, the entire interconnection carrier, with new interconnectors, must be replaced, instead of the single interconnector, and this is both time consuming, expensive and functionally inferior.

Other circuit interconnection techniques have also been used, such as that shown by Chapin et al. in U.S. Pat. No. 5,061,192. While this approach has merit, one must recognize the complex nature of fabricating the individual interconnectors as shown in FIG. 8 of the patent to Chapin et al. Note the use of a plurality of resident contact members, each requiring the painstaking application of interdigitated conductive elements 123 to the terminal ends of each contact member. Here again, cost and reliability are major deterrents to the widespread use of this design.

SUMMARY OF THE INVENTION

It is therefore an object of the present invention to provide a carrier for a pinless connector array with desirable thermal properties, while maintaining good electrical insulating properties.

Another object of the invention is to provide a carrier for supporting a high density of pinless connectors having high life expectancy and reliability.

Yet another object of the invention is to provide a carrier and connector assembly which allows for an easy and effective repair and replacement of any damaged connectors.

According to this invention there is provided an electrically insulative interconnector carrier board for nesting an array of electrically conductive connectors which provide electrical contacts between corresponding electrical contact pads in a series of stacked circuit modules.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
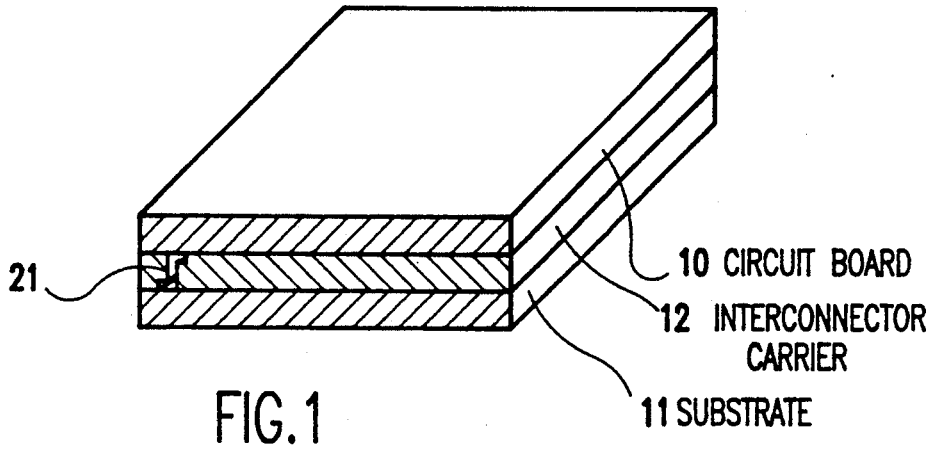
FIG. 1 is an isometric view, partially in cross-section, which shows two stacked circuit boards electrically isolated by an interconnector carrier board.
Figure 2:
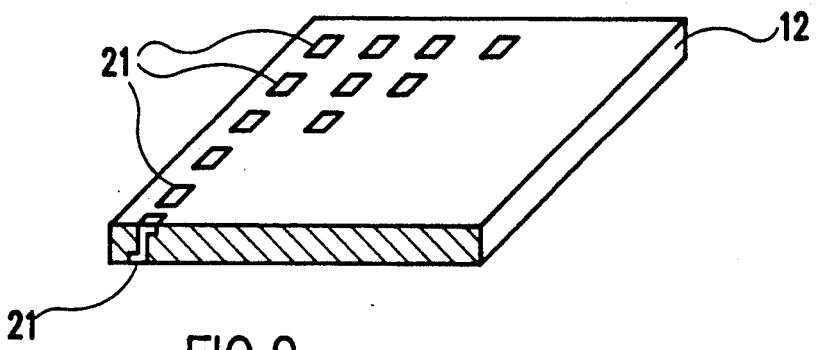
FIG. 2 is an isometric view, partially in cross-section, which shows one embodiment of the interconnector carrier board of FIG. 1 with an array of cavity nests adapted to receive electrical connectors for interconnecting the stacked circuit boards of FIG. 1.

Referring now to the drawings, and more particularly to FIG. 1, two electrical circuit boards 10 and 11 are separated by an interconnector carrier 12 made of an electrically nonconductive layer of material. The circuit boards 10 and 11 are shown as "circuit boards" for illustrative purposes only and can be any type of electrical area arrays, substrates, micro-circuit packages or modules. Each circuit board contains a plurality of electronic components connected to a multiplicity of contact pads arranged for high density usage, normally laid out in a grid array. The interconnector carrier 12, as shown in more detail in FIG. 2, is similarly provided with a multiplicity of contacts (such as shown in detail in FIGS. 3*a*, 3*b*, 4 and 5) in a mating grid array, each contact being housed in a cavity or opening 21. In the microelectronic arts, and particularly in the computer industry, it becomes necessary to reduce hard wiring of circuits, and in order to conserve space and weight, multiple boards are stacked, requiring electrical interconnections therebetween.

In the present instance, the circuit board 10 and the substrate board 11 have corresponding electrical pad connections properly aligned in rows and columns for allowing electrical connections therebetween. The interconnector carrier 12 functions to isolate the two boards 10 and 11 and to hold electrical contacts for interconnecting the circuit boards as desired. The interconnector carrier 12 is more clearly shown in FIG. 2 and depicts a multiplicity of cavities 21 extending through the carrier, which function as nest cavities for securely holding and aligning electrical contact interconnectors in the cavities to electrically interconnect corresponding aligned pads on the respective circuit boards. The interconnector carrier 12, then, functions as the carrier of the electrical contacts, which are hereinafter described in several different embodiments.

The interconnector 12 carrier is preferably made of liquid crystal polymers (LCP) with low dielectric materials, high mechanical strength and good thermal and mechanical stability, and the component materials may be selected to optimize the material properties for performance and processing. The LCP materials can be injection molded, compression molded or extruded in large volumes to fabricate intricate geometries to the specifications and tolerances required for the current and future pinless connector applications. The invention is not, however, limited to LCP materials but can be practiced using other insulating polymeric materials.

Customized LCPs are uniquely suited for fabricating these types of connectors and due to the intrinsic dielectric properties and toughness of these materials they will not degrade. Furthermore, the LCPs can be improved by additives to enhance the thermal dissipation properties. Since the LCPs can be molded, one can incorporate heat dissipating elements (heat sinks), or the LCP can be molded with channels to remove heat from the product. Due to the chemical inertness and stability of the LCPs, one can use fluids or gases to enhance the removal of heat from the product. Furthermore, the thermal coefficient of expansion (TCE) of LCPs matches well with chips and substrates (ceramic or glass-ceramic), giving additional conformity during operation.

Figure 3A:
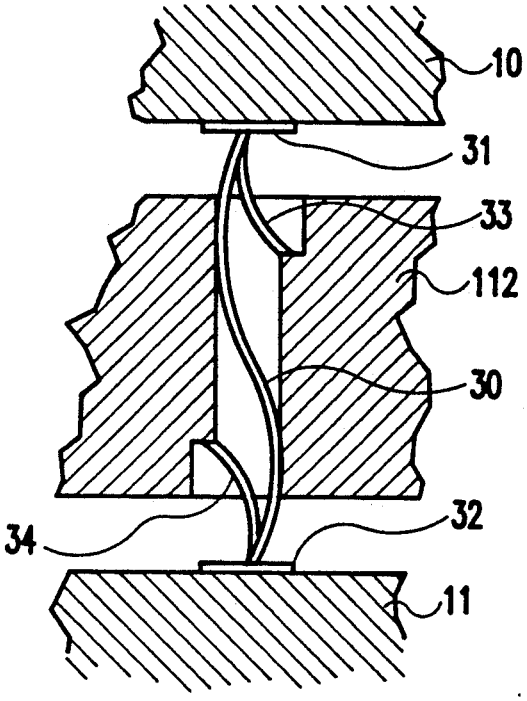
FIGS. 3*a* and 3*b* are cross-sectional side and frontal views, respectively, of one embodiment of a spring connector as used in the cavity nest of an interconnector carrier.
Figure 5:
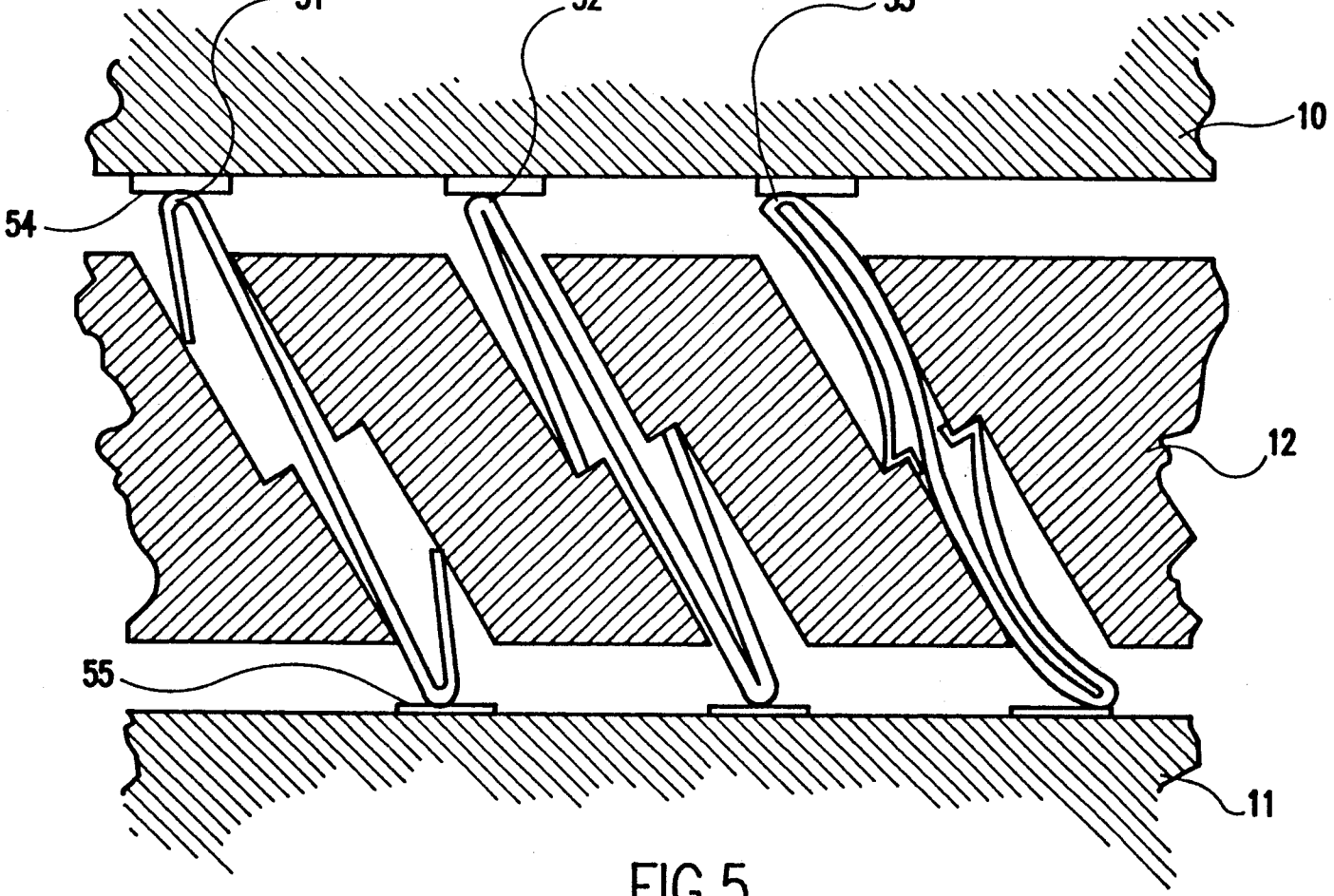
FIG. 5 shows several types of connectors nested in an interconnector carrier for making electrical contact between stacked circuit boards.

The contact holder, or carrier 12, as shown in FIG. 2, is made of an electrically insulating plastic material molded with cavities 21 extending through the layer and designed to accepted a spring contact that will latch-in securely, as shown in FIG. 3*a*. The plastic layer will be provided with the required compliment of cavities and connectors, as well as Diamond pins to help align the pads on the circuit boards to the contacts extending through the support layer. Note that the angle and shape of the holes molded in the interconnector carrier 12 may vary in accordance with the particular design of electrical connector selected. Note that the nest and spring contact connector of FIG. 3*a* is essentially perpendicular to the interconnecting circuit contact pads of the respective circuit boards, but as seen in FIG. 5, it may be desirable to provide a carrier board with nesting holes slanted from the vertical, in order to provide good wipe contact pressure between the electrical connectors and the electrical pads on the respective circuit boards. Note further that each nesting hole has a slight offset on either side of the nest in the direction in which the connector wipes across the contact pads. This pinless interconnector scheme allows for a significantly higher density of connectors with a separation of about 1.2 mm as compared to the old brazed pin grid of about 2.5 mm.

Figure 3B:
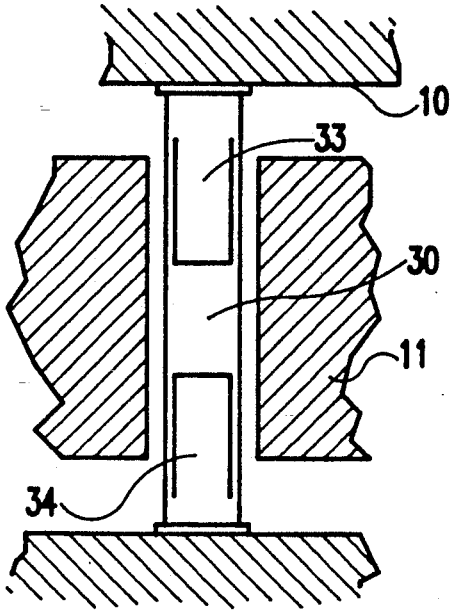

Looking now at FIGS. 3*a* and 3*b*, a spring contact connector 30 is inserted in one of the multiple nests of the interconnector carrier 12 and makes contact with pads 31 and 32 of the respective circuit boards 10 and 11. This method of assembling multiple circuit boards requires that the substrates be provided with properly plated pads that may be of any desired shape, whether round, square or rectangular, so long as the board that will accept the module will be similarly provided. As shown in FIG. 3*a*, the spring connector is under vertical compression from the assembly of the stacked circuit boards, which deforms the spring connector to flex, essentially as shown, causing the two lock tongs 33 and 34 to seat in the offset areas of the nest as shown. FIG. 3*b* shows a frontal view of the same spring connector 30 in FIG. 3*a*, before it has been compressed. Note further that the spring contact is slightly longer than the thickness of the contact carrier 12, such that the proper spring compression action can occur to provide good electrical contact at pads 31 and 32. The scheme for the vertically arranged nest 21 of connector carrier 12, in FIG. 2, is normally used for low density applications, due to a significant increase in pressure normal to the surface of the circuit boards as the number of contacts increase. This increased pressure could conceivably cause the circuit board to fail due to cracking, bulging and deformation of the circuit components on the circuit board.

The electrical contacts or connectors, shown in FIGS. 3, 4 and 5, are made of conductive spring material and may be gold plated and of different thickness or diameter material to provide high current carrying capacity contacts. A number of different connector designs are envisioned for this application, with several shown in the above referenced figures. The connectors may be "stamped and formed", or "wire formed" contacts, where higher densities are desired. They may be fabricated of any good electrically conductive material having good springiness and durability. A typical "S" type connector body was built from aluminum because of its low cost, and was then anodized, which provided an added advantage of having excellent heat transfer and dissipation characteristics.

Figure 4A:
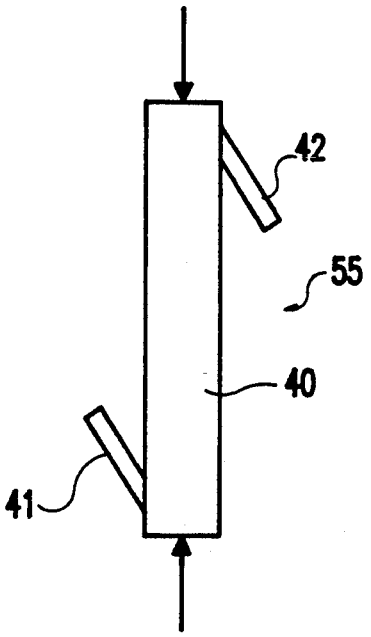
FIGS. 4*a* and 4*b* are a side and frontal views of another embodiment of a spring connector as carried by the interconnector carrier of FIG. 2.
Figure 4B:
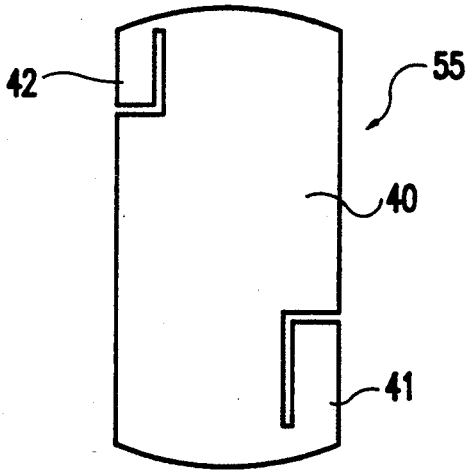

Looking now at FIGS. 4*a* and 4*b*, there are shown side and frontal views of another connector indicated by the general reference numeral 55 that could be used in the interconnector carrier 12 of FIG. 2. Lock tabs 41 and 42 of FIG. 4*b* are sprung outwardly from the plane of a connector body 40, thus providing a "snap-in" fit for locking the tabs into the depressions molded into cavity 21 when placed in the cavity during assembly. As best seen in FIG. 4*b*, the ends of the connector are slightly convex to promote a good electrical contact with pads 31 and 32 shown in FIG. 3*a*. This connector 55 may be effectively used in either the vertical or the slanted nesting cavity, as can any connector having a flexing action in the body of the connector, as long as the normal forces applied to the contact pads are not of a damaging level. These connectors, as well as the others herein described, are so designed such that a connector removal tool can be easily employed to depress the spring contacts for easy removal and replacement, even in a field environment.

FIG. 5 depicts the interconnector carrier 12 of FIG. 2 having nesting cavities molded on a slant from the vertical. The angle of slant does not appear to be critical, however, a slant of about 40° from the vertical has been found to provide good pressure between the spring connectors and the pads and allows for increased density arrays of connectors and for the capability of increased power handling through the contacts. Use of a carrier substrate having nesting cavities molded at an angle less than 90° to the substrate will allow the use of thicker materials for the connectors, which will reduce the bulk resistance of the connector and increase the current carrying capacity of the contact. The thicker material will now permit reduction of the contact width, thus permitting contact density increase and the contact wipe action will increase because of the inclined contact orientation.

FIG. 5 further shows several types of connectors mounted in the carrier plate 12, which denotes that selective high power connectors may be inserted at any desired location. Connectors 51 and 52 are "S" type connectors which provides springiness by compression of the contacts. Connector 51 is shown to be mounted in a nest cavity and provides good contact at the circuit board pads 54 and 55. Note that the end of the spring connector rides along the wall of the cavity nest and that the rounded portions of the connector, in contact with the pads 54 and 55, has a more rounded contact end than does the ends of connector 52, such that connector 51 has more surface area contacting pads 54 and 55 than does connector 52; therefore, connector 51 will have better current carrying capacity. Looking now at connector 53, which is normally referred to as a "Z" connector, as opposed to the "S" connectors 51 and 52. The "Z" connector has an even greater current carrying capacity than connector 51, as the slight curvature of the contact portion of the "Z" connector, at the contact pads, provide approximately double the contact surface area of connector 51, due to the design of the curvature of the tip of the "Z" connector at the point of contact with the contact pad which provides a compressional force normal to the surface of the contact pad.

While the invention has been described in terms of several preferred embodiments, those skilled in the art will recognize that the invention can be practiced with modification within the spirit and scope of the appended claims.

Having thus described our invention, what we claim as new and desire to secure by Letters Patent is as follows:

1. An electrical circuit assembly comprising:

at least two electronic circuit boards having corresponding arrays of electrical contact pads;

an electrically insulative, unitary connector carrier with a high mechanical strength for an array of pinless electrical connectors, disposed between the circuit boards, having an array of cavity nests within said carrier, corresponding in like position to the arrays of contact pads associated with the circuit boards, wherein said connector carrier is a unitary sheet and each cavity nest within said array is adapted to receive an electrical connector for interconnecting a corresponding electrical contact pad in each said array of electrical contact pads and, further, wherein each cavity nest has two opposing side walls with two offset portions on opposite sides of the opposing side walls of the cavity nest for retaining an electrical connector upon the insertion thereof into said unitary sheet after it has been formed with said cavity nests therein; and a multiplicity of electrical connectors, each connector of said multiplicity of electrical connectors being inserted into said each cavity nest formed in said unitary sheet through an opening formed by said each cavity nest in an exterior surface of said unitary sheet, said each connector made of a spring like, flexible material exhibiting good electrical conductivity, with said each connector being inserted into a cavity nest within the array, with said each connector being slightly longer than the depth of a cavity nest in which it is inserted, such that an end of said each connector extends beyond both surfaces of the carrier to assure good electrical contact between the multiplicity of electrical connectors and the arrays of electrical contact pads on each respective circuit board, when properly assembled, and wherein said each connector further includes at least two securing means for securing the connector within the cavity nest.

2. The electrical circuit assembly of claim 1, wherein the opposing side walls of the cavity nests in the connector carrier are slanted at an angle with respect to a line normal to a planar surface of the connector carrier, such that each end of each connector that extends beyond the surfaces of the carrier is offset with respect to said line normal to the planar surface of the connector carrier with the offset of opposite ends in opposite directions from said line so that the pressure applied normal to the electrical contact pads of the module array is reduced in direct proportion to the angle of slant, thus providing for an increased density array without exceeding a maximum safe pressure impinging on a module surface.

3. The electrical circuit assembly of claim 2, wherein the electrical connectors are in an "S" shapes, such that, upon insertion thereof within the cavity nest, legs of the connector are somewhat compressed, and upon their release the legs are forced against a side wall of the cavity, whereby movement of the connector within the cavity is limited by the side walls.

4. The circuit assembly of claim 1, wherein the connector carrier is fabricated of a liquid crystal polymer.

5. The circuit assembly of claim 4, wherein the electrical connectors are fabricated of aluminum for good conductivity and anodized to provide good heat transfer and dissipation characteristics.

6. An electrical circuit assembly comprising:

at least two electronic circuit boards having corresponding arrays of electrical contact pads;

an electrically insulative connector carrier for an array of pinless electrical connectors, disposed between the circuit boards, having an array of cavity nests within said carrier, corresponding in like position to the arrays of contact pads associated with the circuit boards, wherein each cavity nest within said array is adapted to receive an electrical connector for interconnecting the corresponding electrical contact pad in each said array and, further, wherein each cavity nest contains at least two offset portions on opposite sides and opposite ends of the cavity nest for seating the electrical connector and for securing same upon the insertion thereof; and a multiplicity of electrical connectors, each made of a spring like, flexible material exhibiting good electrical conductivity, with each being inserted into a cavity nest within the array, with each connector being slightly longer than the depth of the cavity nest, such that the end of each connector extends beyond both surfaces of the carrier to assure good electrical contact between the multiplicity of electrical connectors and the arrays of electronic contact pads on each respective circuit board, when properly assembled, and wherein each connector further includes at least two securing means for seating the connector within the cavity nest;

said cavity nests in the connector carrier be slanted at an angle with respect to a line normal to a planar surface of the connector carrier, such that the pressure applied normal to the electrical contact pads is reduced in direct proportion to the angle of slant, thus providing for an increased density array without exceeding a maximum safe pressure impinging on a module surface, and said connectors being formed in a "Z" shape, with each leg having an end portion shaped with a 90° bend for locking onto a respective one of said two offset portions of the cavity for securing the connector therein, and said connector further having a slow bending curvature at a point of contact with the electrical contact pads such that a spring force applied to the contact pads would be normal thereto, thus providing enhanced electrical contact with an increased current carrying capacity for the connector.

7. The circuit assembly of claim 6, wherein the cavity nests within the connector carrier are slanted from the line normal to effect an approximate 40° slant angle.

* * * * *